US006688792B1

(12) United States Patent
Reichmann et al.

(10) Patent No.: US 6,688,792 B1
(45) Date of Patent: Feb. 10, 2004

(54) STACKABLE MARKERS

(75) Inventors: Andre Reichmann, Port Washington, NY (US); Mark Dobbs, Port Washington, NY (US)

(73) Assignee: Dri Mark Products, Inc., Port Washington, NY (US)

( * ) Notice: Subject to any disclaimer, the term of this patent is extended or adjusted under 35 U.S.C. 154(b) by 0 days.

(21) Appl. No.: 10/303,490

(22) Filed: Nov. 22, 2002

Related U.S. Application Data

(63) Continuation-in-part of application No. 29/168,667, filed on Oct. 4, 2002.

(51) Int. Cl.[7] ..... B43K 27/04
(52) U.S. Cl. ..... 401/34; 401/18
(58) Field of Search ..... 401/18, 17, 16, 401/23, 34, 35, 56, 57, 59, 90, 202; D19/36, 43, 44

(56) References Cited

U.S. PATENT DOCUMENTS

D300,087 S * 3/1989 Henderson ..... D3/63
5,044,804 A * 9/1991 Chuang ..... 401/34
5,688,062 A * 11/1997 Shih ..... 401/18
5,957,601 A * 9/1999 Weiss ..... 401/18
6,019,535 A * 2/2000 Turner ..... 401/52
6,149,330 A * 11/2000 Chuang ..... 401/57
6,161,975 A * 12/2000 Clarke ..... 401/34

* cited by examiner

*Primary Examiner*—Gregory L. Huson
*Assistant Examiner*—Huyen Le
(74) *Attorney, Agent, or Firm*—Ostrolenk, Faber, Gerb & Soffen, LLP

(57) ABSTRACT

A stacked marker is formed by stacking individual stackable markers where each stackable marker is a fully functional marker and each stackable marker can be selected for use and then reassembled to store the restackable marker. Each stackable marker is originally assembled as an otherwise ordinary marker, but with a temporary utility cap, which, upon being inserted into a rear receptacle in another marker, is left therein to form the permanent cap for other markers. When fully assembled, the stacked marker becomes a multi-unit final assembly that affords one the use of a plurality of different types of markers that are snapped together during non-use and taken apart to select individual markers during use.

22 Claims, 6 Drawing Sheets

10
12
16
14

10b
12a
12b
16
14

10c
12a
12b
12c
16
14

10d
12a
12b
12c
12d
16
14

14
15
12c
10c
12b
19
12a
19

23
22
12a
24
20
18

STACKABLE MARKERS

BACKGROUND OF THE INVENTION

This is a continuation-in-part (CIP) of design patent application Ser. No. 29/168,667 filed Oct. 4, 2002, the contents of which are incorporated by reference herein.

The present invention relates to writing implements and, more particularly, to a marker-style writing and drawing implement that is constructed of plural stackable and individually usable marker parts.

The instant inventors are aware of a pencil product with stackable parts and comprising a single outer barrel and individual, miniature round bodies, each supporting a sharpened pencil tip, which are stackable above one another, so that when a particular pencil tip becomes dull, it is removed from the writing end of the barrel and forcibly inserted through the rear opening of the barrel to push out another sharpened pencil tip. Conventional wisdom does not disfavor the stacking of pencil or even pen parts, inasmuch as the writing end of these parts are not subject to drying, if exposed to the environment over prolonged periods.

In marked contrast, marker products have constantly wetted felt or fabric tips, which must be quickly and hermetically sealed when the product is not in use, in order to avoid the drying up of the product, or rendering the product inoperable. Therefore, it has been deemed counter-intuitive to provide stackable marker products, because they would require producing the individual components of a stackable marker with temporary caps that prevent drying until the products have been stacked together, after which the temporary caps would have to be thrown away. This results in the production of extra parts, unnecessary manufacturing steps and, therefore, an extra cost.

SUMMARY OF THE INVENTION

Accordingly, it is a general object of the present invention to provide stackable markers that provide the capability of assembling multiple color markers in a single, hand-held marker product.

It is a further object of the invention to provide a stackable marker product that can be easily and inexpensively produced.

It is a further object of the invention to provide a stackable marker that provides good sealing between the stackable markers, so as to prevent unnecessary evaporation of highlighter or ink formulations.

The foregoing and other objects of the invention are realized with a stackable marker or a kit of individual marker products that can be stacked together to create a single utilitarian, hand-held marker that enables providing individual marker components, in different colors or different types of nibs or different types of writing characteristics.

More specifically, the invention is preferably directed to a stackable marker, a plural number of which can be combined to form a composite stacked marker. Each stackable marker component has a barrel with a first longitudinal opening and a second longitudinal opening and an interior space therebetween. The second longitudinal opening is sealed from the interior space by an interior wall with the space between the interior wall and the second longitudinal opening defining a receptacle for a cap of another stackable marker.

A marker filler is provided in the interior space on the other side of the interior wall and a marker nib penetrates through the first opening and is coupled to the filler and is held at the first opening by a nib retainer, with a portion of the nib protruding outwardly.

A utility nib cap is initially affixed to the barrel of each stackable marker during the manufacture or assembly thereof. That utility nib cap seals the protruding end of the nib to the barrel, protecting the nib against drying. The utility nib cap is so shaped and constructed, that when the stackable markers are thereafter intercoupled with one another, the insertion thereof into the receptacle of another stackable marker causes the utility nib to remain fixed in the other utility marker to subsequently form the cap for any stackable marker that is thereafter inserted therein.

The utility nib cap is so constructed and shaped, that the frictional holding force on the outer surface thereof, with the interior surface of the receptacle, causes it to be held therein, while the frictional force between the interior surface of the utility nib cap with the nib end of another marker is of lesser magnitude. Thereby, the composite stacked marker holds together firmly. But the stackable markers can nonetheless be pulled apart and reassembled as often as is desired or necessary.

The individual markers can have different marker formulations or be of different colors or of different characteristics. For example, a marker formulation that is capable of erasing other marks that are made with other types of markers can be provided.

Other features and advantages of the present invention will become apparent from the following description of the invention which refers to the accompanying drawings.

DETAILED DESCRIPTION OF THE PREFERRED EMBODIMENTS

Figures 1A, 1B, 1C, 1D:
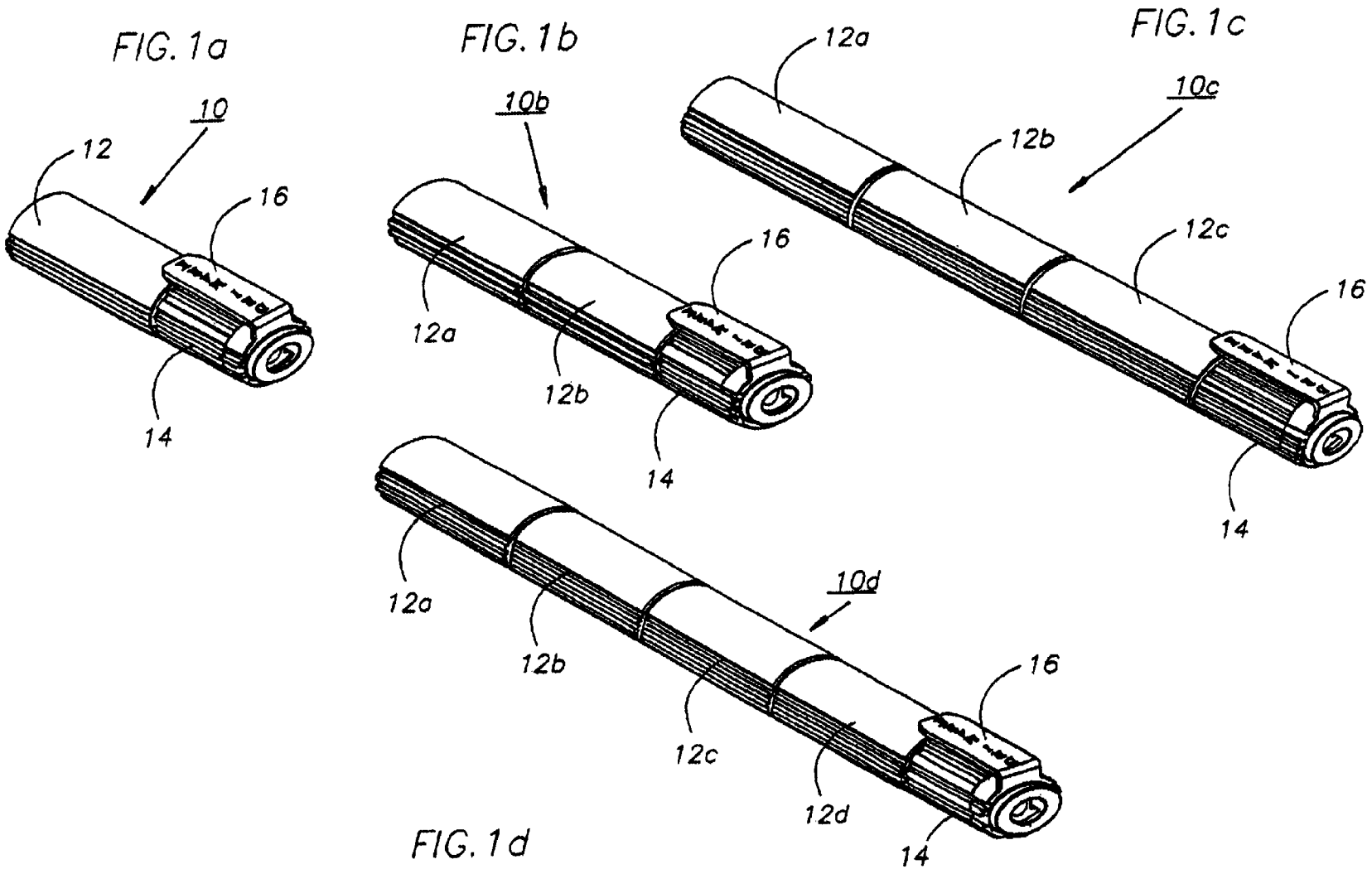
FIGS. 1*a*, 1*b*, 1*c* and 1*d*, perspectively and respectively illustrate a stackable marker containing single, double, triple, and quadruple stacked markers.

With reference to the drawings, FIG. 1*a* shows a single stacked marker 10 comprising an oval-shaped barrel 12 with a nib end cap 14 and a clip 16 affixed to the free end thereof. The clip 16 can be marked with commercial insignia, such as, for example, the name of a company, e.g., Dri Mark, as illustrated.

FIG. 1*b* shows a double stacked marker 10*b* with individual stacked barrels 12*a* and 12*b* with a single cap 14 and clip 16. In similar fashion, FIG. 1*c* shows a triple stacked marker 10*c*, with barrels 12*a*, 12*b*, 12*c*, nibcap 14 and clip 16. In the same vein, the stackable marker 10*d* of FIG. 1*d* includes individual markers 12*a*, 12*b*, 12*c* and 12*d*.

Preferably, each of the individual markers dispenses a marker fluid of a color different from the other colors. Optionally, one of the markers is provided as an erasing marker that is able to erase the markings applied by the other stackable markers. As shown, the stackable markers of the invention can be provided with any number of such individual markers, for example, two, three, etc., including as many as ten or more.

Figure 4:
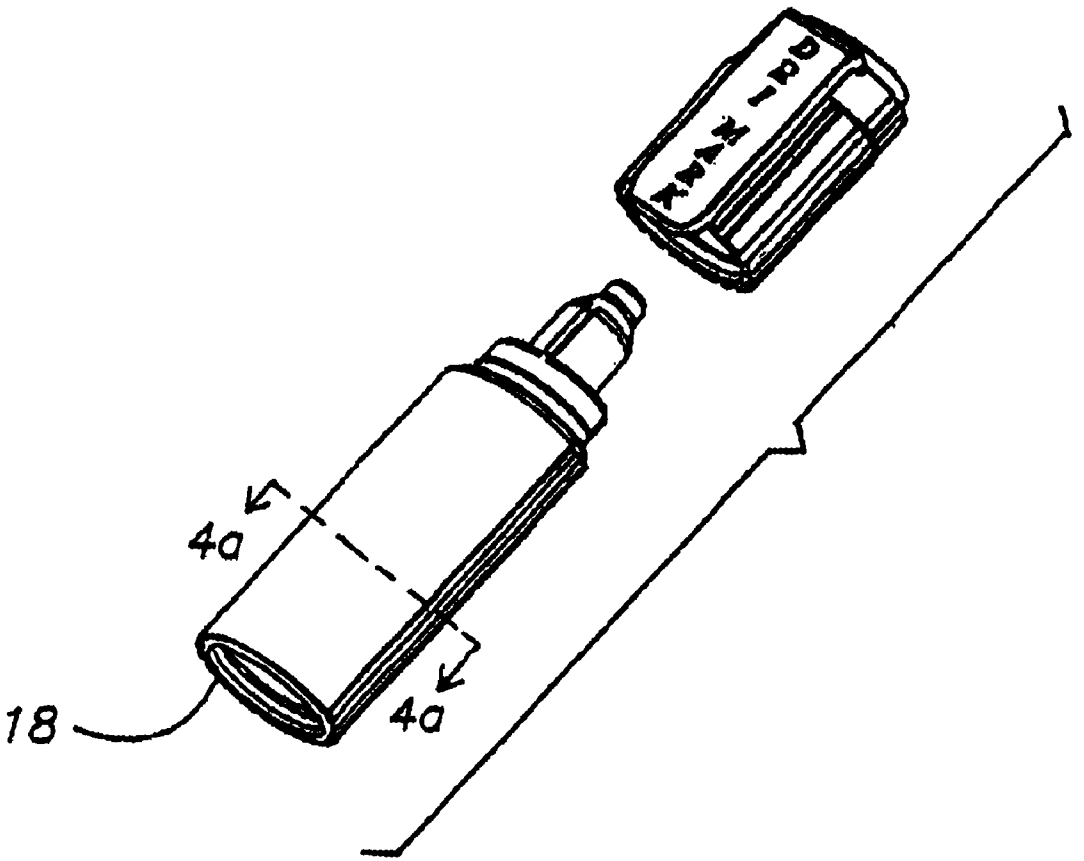
FIG. 4 shows a preassembled single stackable marker.
Figure 4A:
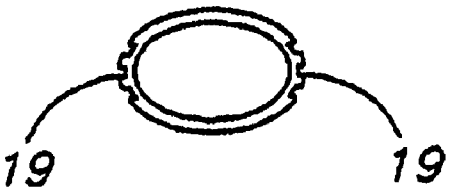
FIG. 4*a* shows a view of FIG. 4 in the direction of lines 4*a*—4*a* thereof.

As shown in FIGS. 4 and 4*a*, the outer barrel body 18, of each individual marker has an oval cross-sectional shape. The opposed sides of the oval-shaped barrel body may be ridged, as indicated at 19, to provide comfort, better handling in use, as well as stylistic effects.

Figures 2, 2A:
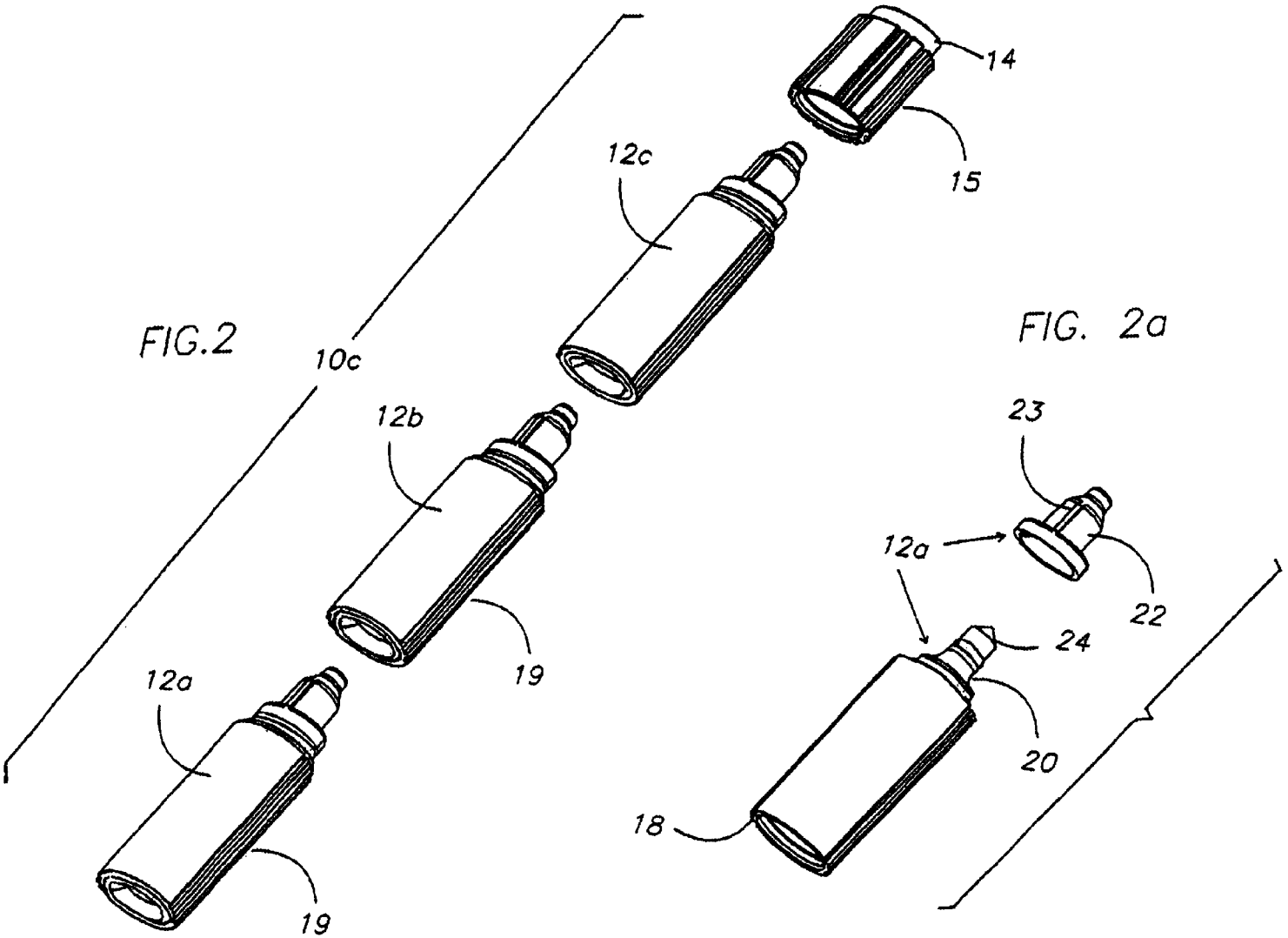
FIG. 2 perspectively shows individual stackable marker components that are shown in exploded view, prior to their being assembled into a single, double, etc., stacked marker.
FIG. 2*a* shows a single one of the stackable submarkers illustrated in FIG. 2.

FIG. 2 shows the individual marker components 12*a*, 12*b*, and 12*c* that make up the composite stack marker 10*c* shown in FIG. 1*c*. Each of these components, for example, the marker component 12*a*, consists of an otherwise conventional marker with a barrel 18, a marker nib 24 that is capped and held in proper position partially extending out of the barrel 18 by a nib retainer 20. The nib retainer 20, or outer barrel surface of each marker may be colored or marked to identify the color or characteristic of the marker fluid within.

Most significantly, each of the stackable individual markers 12*a* and 12*b* is initially produced with its nib 24 enclosed by a utility cap 22, which keeps the exposed nib fully sealed against the elements so it would not dry and have a long shelf life, permitting much later assembly into the actual composite stacked marker. The utility cap 22 seals the individual barrel unit at assembly, providing a filled sub-assembly that can be stored for future use in multi-unit final assemblies.

The shape and surface of the utility cap 22 enable it to snap into the bottom openable end 18*b* (FIG. 3*b*) of an adjacent stackable barrel sub-assembly and, once inserted, to remain fixed in the barrel. This initial act transforms the bottom of each barrel into the cap of another individual marker. In other words, once the sub-assembly marker products 12*a*, 12*b* and 12*c* shown in FIG. 2 have been assembled with one another, their individual utility caps become lodged in the otherwise open end 18*b* of adjacent barrels 18 of another sub-assembly. The utility cap 22, once inserted, remains in the barrel of the adjacent sub-assembly or within the cap 14 (FIG. 2, 3*a* or 3*b*), providing the assembly feature along with the sealing component for the cap to another barrel.

Since the utility cap 22 and stackable barrel sub-assemblies 18 can be stored individually by color, final multi-unit stackable markers, e.g., 10*b*, 10*c*, 10*d*, can be assembled with the exact colors requested by a customer, without the need to custom fill each assembly. Picking the necessary parts and final "snap-together" assemblies is all that is required to fill orders, greatly reducing the time required and the costs involved. This feature also reduces the inventory necessary to provide customer color choices.

Since the utility cap 22 also creates the assembly feature for the outer cap 14, this outer cap 14 can also be customized by color and style and assembled with the other stackable barrels at final assembly.

The utility cap 22 simplifies assembly because it becomes an integral part of the sub-assembly and does not require the removal and discarding of any temporary sealing caps used only for storage purposes.

Figure 6:
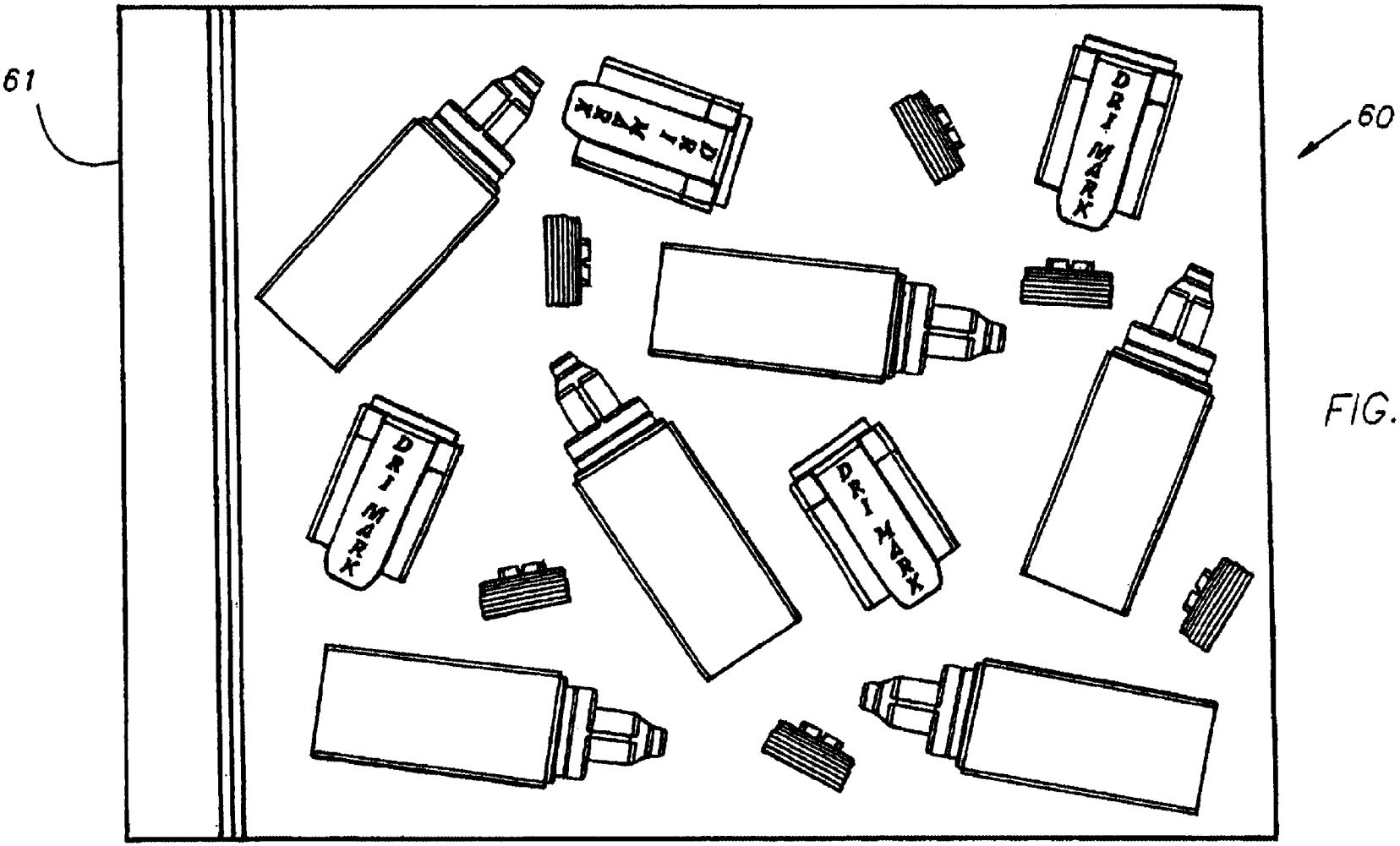
FIG. 6 shows a kit holding numerous stackable marker parts, which can be used by an end user to create one or more composite stacked markers.

As further illustrated in FIG. 6, the invention can also be provided in the form of a kit 60 of parts comprising a plurality of marker sub-assemblies 12*a*, 12*b*, 12*c* in a large number, for example, 12 or 20 or even 30, with one or more caps 14 and in various colors and including several barrel plugs-18*c* (FIG. 3*a*), such as to enable an end user to actually construct several stackable markers according to their own choice of color combinations and number of stackable markers and arrangements to suit individual needs. The kit 60 of the aforementioned parts is provided in a plastic bag 61, illustrated in FIG. 6.

Figures 3A, 3B, 3C:
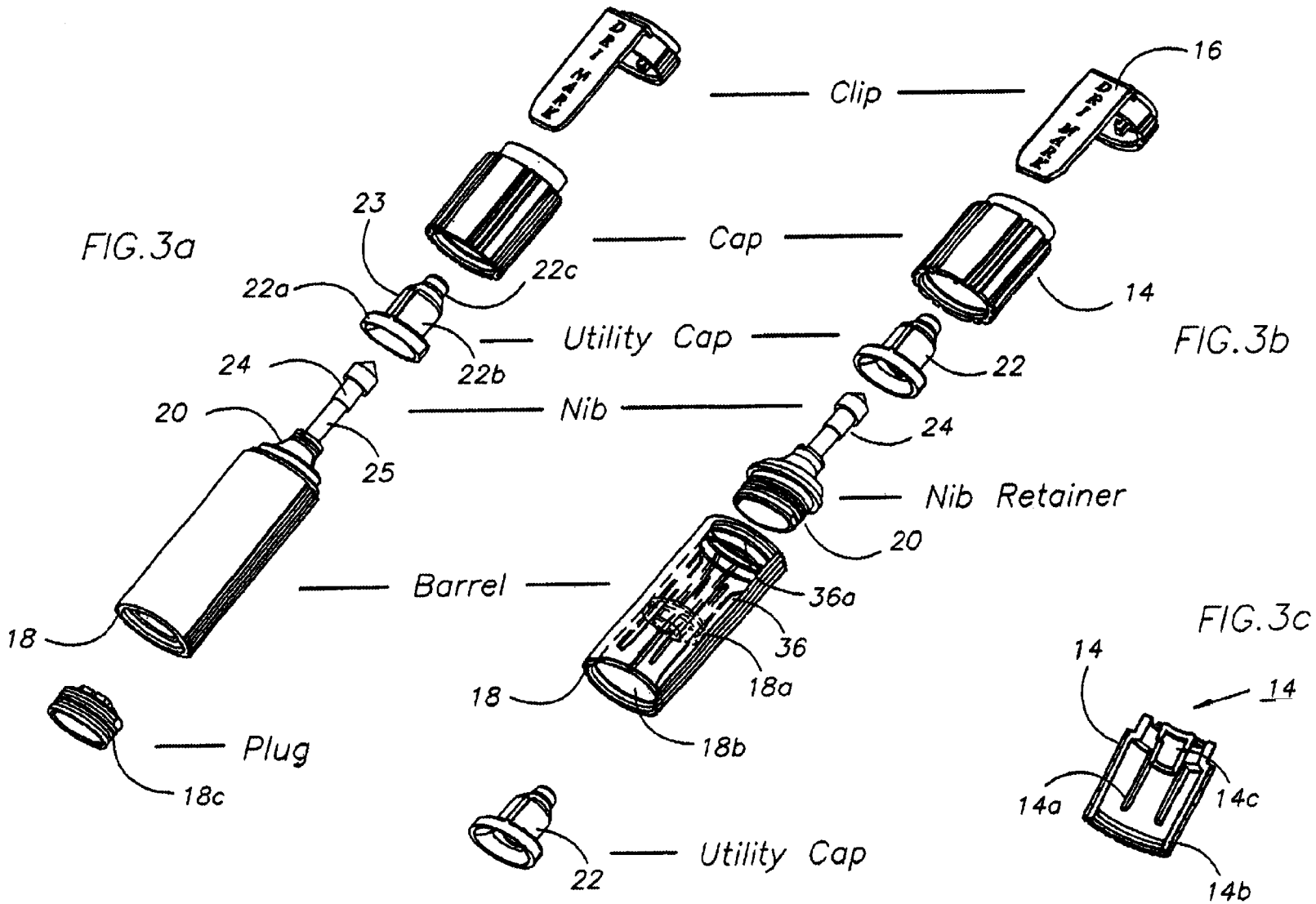
FIG. 3*a* and FIG. 3*b* are an exploded view of a single, stackable marker part with a cap and clip therefor.
FIG. 3*c* shows a cap portion for the stackable marker, partially cut away to show interior details.

With further reference to FIG. 3*b*, each barrel 18 comprises an internally located marker filler 36 that is suffused with marker fluid of a particular color or characteristics (for example, eraser fluid), which is further provided with a central opening 36*a* that receives the free end of the nib 24 that emerges within the barrel 18 through the nib retainer 20. This occurs when the nib retainer is fully inserted through the nib retainer, as illustrated in FIG. 2*a*. The interior of the barrel 18 is sealed by a diaphragm wall 18*a*, as shown in FIG. 3*b*, such that when the barrel is assembled with the nib retainer 20, the nib 24, filler 36 and the utility cap 22 is attached as shown in any of the marker sub-assemblies in FIG. 2, the filler 36 and the nib 24 are protected against evaporation, clogging and drying up, enabling a long shelf life.

Referring now to FIG. 3*c*, the cap 14 of FIG. 3*b* is shown with the interior thereof partially exposed to show axially extending ribs 14*a* disposed along the right and left peripheral sides thereof, as well as circumferentially extending rings 14*b* and a constricted opening 14*c*. The ribs 14*a* and 14*b* are arranged to mate with and orient the insertion of the utility cap 22, such that the grooves 23 located on the central body 22*b* (FIG. 3*a*) thereof, mate with one another with the circumferential rings 14*b* providing strong frictional hold on the utility cap. Additional frictional hold is obtained by the narrowed diameter tip 22*c* of the utility cap 22 engaging tightly the receiving hole 14*c* in the cap 14, so that once the utility cap 22 is inserted, it will not come out as the barrel 18 is disengaged from the cap. A similar arrangement of longitudinally as well as circumferentially extending rings or ribs is provided in the bottom opening 18*b* of the barrel.

Figure 5B:
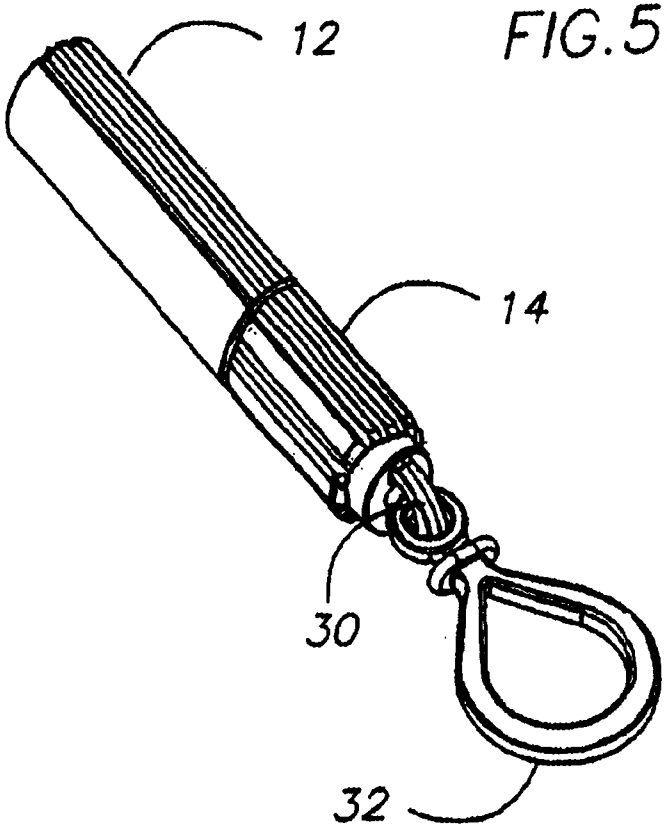
FIG. 5*b* shows a single stacked marker with a holding loop in combination with a key ring.
Figure 5A:
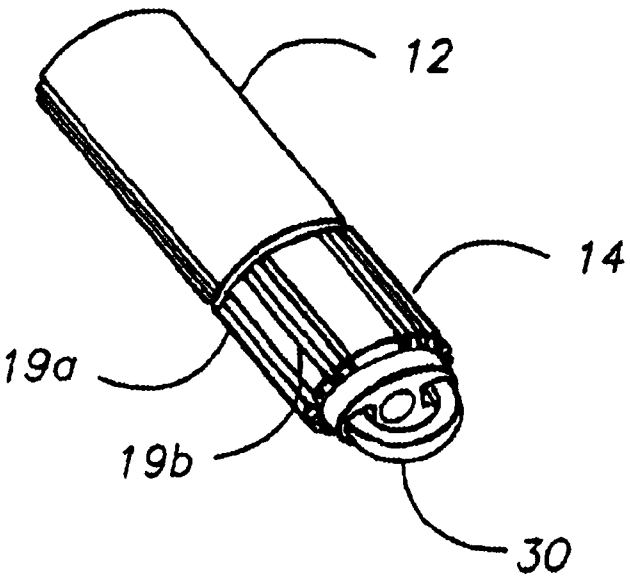
FIG. 5*a* shows a stackable marker with a holding loop.

The utility cap 22 may be fabricated of low density polyethylene and the circumferential skirt-like collar 22*a* thereof locks tightly onto the nib retainer to provide effective sealing when the barrel 18 with its nib 24 is pushed into the utility cap 22. With reference to FIGS. 5*a* and 5*b*, the stackable markers of the present invention can be provided such that the caps 14 include a holding loop 30 with or without an additional key ring 32 as shown. Moreover, the cap 14 is provided with side ridges 19*a*, as well as additional longitudinally extending ridges 19*b* that provide both stylistic effect and better gripping during use.

As described above, and as is clearly evident from FIGS. 1*b*, 1*c* and 1*d*, the utility cap is designed such that once it is inserted, it is substantially entirely received within the barrel in which it has been inserted and will not again be used as a marker cap accessible to the user. When a plurality of barrels are stacked together, for example, the marker barrels 12*a*, 12*b*, 12*c* and 12*d*, they are either in abutting or almost abutting position, creating a smooth composite marker product in which the utility cap is essentially not visible, as shown in the drawings.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A stackable marker, a plural number of which can be combined to form a composite stacked marker, the stackable marker comprising:

a barrel having a first longitudinal opening and a second longitudinal opening and an interior space therebetween, the barrel defining a receptacle for a cap of another stackable marker;

a marker filler in the interior space and a marker nib extending through the first opening and being coupled with the filler and being held at the first opening by a nib retainer with a portion of the nib protruding outwardly; and a utility nib cap affixable to the barrel and sealing the protruding end of the nib to the barrel, the utility nib cap being so shaped and constructed, that upon the insertion thereof into the receptacle of another stackable marker, it is substantially entirely received within the receptacle of the other stackable marker, remains affixed therein and subsequently forms a cap for such other stackable marker, whereby when the plurality of the barrels of respective markers are positioned following one another, the utility caps are substantially concealed.

2. The stackable marker of claim 1, wherein the second longitudinal opening is sealed from the interior space by an interior wall.

3. The stackable marker of claim 2, in which the utility nib cap is constituted of a low density polyethylene material.

4. The stackable marker of claim 2, in which the utility nib cap has a circumferential size that is smaller than the circumferential size associated with the barrel adjacent the second longitudinal opening thereof.

5. The stackable marker of claim 2, in combination with another similarly constructed stackable marker and assembled with one another to form a composite stacked marker.

6. The stackable marker of claim 2, including four stackable markers rigidly interfitted to be held in a person's hand as a single composite, stacked marker.

7. The stackable marker of claim 2, wherein the utility nib cap is snap-connected within the receptacle of another stackable marker.

8. The stackable marker of claim 2, further including a holding loop.

9. The stackable marker of claim 8, further including a key ring coupled to the holding loop.

10. The stackable marker of claim 2, in combination with a plurality of other stackable markers and each of the markers having a different marker characteristic.

11. The stackable marker of claim 10, in which the different characteristics comprise different marker colors.

12. The stackable marker of claim 10, in which the different characteristics comprise different marker formulations.

13. The stackable marker of claim 12, in which the different marker formulations include at least a highlighter formulation and an opaque ink formulation.

14. The stackable marker of claim 10, in which the different characteristics include an erasing formulation.

15. The stackable marker of claim 10, including a visible indication on each marker characteristic.

16. A stackable marker, a plural number of which can be combined to form a composite stacked marker, the stackable marker comprising:

a barrel having a first longitudinal opening and a second longitudinal opening and an interior space therebetween, the barrel defining a receptacle for a cap of another stackable marker;

a marker filler in the intenor space and a marker nib extending through the first opening and being coupled with the filler and being held at the first opening by a nib retainer with a portion of the nib protruding outwardly;

a utility nib cap affixable to the barrel and sealing the protruding end of the nib to the barrel, the utility nib cap being so shaped and constructed, that upon the insertion thereof into the receptacle of another stackable marker, it remains affixed therein and subsequently forms a cap for such other stackable marker; and a top end cap for the stackable marker, the top end cap having at one end thereof a receptacle fitted to receive and retain the utility nib cap, once the same has been inserted therein.

17. A stackable marker, a plural number of which can be combined to form a composite stacked marker, the stackable marker comprising:

a barrel having a first longitudinal opening and a second longitudinal opening and an interior space therebetween, the barrel defining a receptacle for a cap of another stackable marker;

a marker filler in the interior space and a marker nib extending through the first opening and being coupled with the filler and being held at the first opening by a nib retainer with a portion of the nib protruding outwardly;

a utility nib cap affixable to the barrel and sealing the protruding end of the nib to the barrel, the utility nib cap being so shaped and constructed, that upon the insertion thereof into the receptacle of another stackable marker, it remains affixed therein and subsequently forms a cap for such other stackable marker, wherein the second longitudinal opening is sealed from the interior space by an interior wall; and longitudinal grooves on a center portion of the utility nib cap and including longitudinal ribs in the receptacle, enabling the ribs and the grooves to mate with one another to thereby orient an improve the holding ability of the nib cap within the receptacle.

18. A stackable marker, a plural number of which can be combined to form a composite stacked marker, the stackable marker comprising:

a barrel having a first longitudinal opening and a second longitudinal opening and an interior space therebetween, the barrel defining a receptacle for a cap of another stackable marker;

a marker filler in the interior space and a marker nib extending through the first opening and being coupled with the filler and being held at the first opening by a nib retainer with a portion of the nib protruding outwardly;

a utility nib cap affixable to the barrel and sealing the protruding end of the nib to the barrel, the utility nib cap being so shaped and constructed, that upon the insertion thereof into the receptacle of another stackable marker, it remains affixed therein and subsequently forms a cap for such other stackable marker, wherein the second longitudinal opening is sealed from the interior space by an interior wall, and in combination with another similarly constructed stackable marker and assembled with one another to form a composite stacked marker; and an end cap to close the receptacle of a marker into which another stackable marker has not been inserted.

19. A kit of parts that enables the assembly of a composite stacked marker comprising a plurality of individual stackable markers interfitted with one another, the marker parts including individual stackable markers, each stackable marker comprising:

a barrel having a first longitudinal opening and a second longitudinal opening and an interior space therebetween, the second longitudinal opening being sealed from the interior space by an interior wall, the barrel defining a receptacle for a cap of another stackable marker;

a marker filler in the interior space and a marker nib extending through the first opening and being coupled with the filler and being held at the first opening by a nib retainer with a portion of the nib protruding outwardly; and a utility nib cap affixable to the barrel and sealing the protruding end of the nib to the barrel, the utility nib cap being so shaped and constructed, that upon the insertion thereof into the receptacle of another stackable marker, it is substantially entirely received within the receptacle of the other stackable marker remains affixed therein and subsequently forms a cap for such other stackable marker, whereby when the plurality of the barrels of respective markers are positioned following one another, the utility caps are substantially concealed.

20. A kit of parts that enables the assembly of a composite stacked marker comprising a plurality of individual stackable markers interfitted with one another, the marker parts including individual stackable markers, each stackable marker comprising:

a barrel having a first longitudinal opening and a second longitudinal opening and an interior space therebetween, the second longitudinal opening being sealed from the interior space by an interior wall, the barrel defining a receptacle for a cap of another stackable marker;

a marker filler in the interior space and a marker nib extending through the first opening and being coupled with the filler and being held at the first opening by a nib retainer with a portion of the nib protruding outwardly;

a utility nib cap affixable to the barrel and sealing the protruding end of the nib to the barrel, the utility nib cap being so shaped and constructed, that upon the insertion thereof into the receptacle of another stackable marker, it remains affixed therein and subsequently forms a cap for such other stackable marker; and at least one bottom-end plug for closing the receptacle of a marker into which another marker is not insertable; and a top-end cap defining a receptacle and lacking any marker filler.

21. A method for assembling a composite stacked marker, comprising a plurality of individual stackable markers interfitted with one another, the method including the steps of:

providing the individual stackable markers with each stackable marker including, a barrel having a first longitudinal opening and a second longitudinal opening and an interior space therebetween, the second longitudinal opening being sealed from the interior space by an interior wall, the barrel defining a receptacle for a cap of another stackable marker;

a marker filler in the interior space and a marker nib extending through the first opening and being coupled with the filler and being held at the first opening by a nib retainer with a portion of the nib protruding outwardly; and a utility nib cap affixable to the barrel and sealing the protruding end of the nib to the barrel, the utility nib cap being so shaped and constructed, that upon the insertion thereof into the receptacle of another stackable marker, it is substantially entirely received within the receptacle of the other stackable marker, remains affixed therein and subsequently forms a cap for such other stackable marker, whereby when the plurality of the barrels of respective markers are positioned following one another, the utility caps are substantially concealed interfitting a plurality of the individual stackable markers with one another, to form the composite stacked marker.

22. A method for assembling a composite stacked marker, comprising a plurality of individual stackable markers interfitted with one another, the method including the steps of:

providing the individual stackable markers with each stackable marker including, a barrel having a first longitudinal opening and a second longitudinal opening and an interior space therebetween, the second longitudinal opening being sealed from the interior space by an interior wall, the barrel defining a receptacle for a cap of another stackable marker;

a marker filler in the interior space and a marker nib extending through the first opening and being coupled with the filler and being held at the first opening by a nib retainer with a portion of the nib protruding outwardly; and a utility nib cap affixable to the barrel and sealing the protruding end of the nib to the barrel, the utility nib cap being so shaped and constructed, that upon the insertion thereof into the receptacle of another stackable marker, it remains affixed therein and subsequently forms a cap for such other stackable marker;

interfitting a plurality of the individual stackable markers with one another, to form the composite stacked marker; and fitting to the composite stacked marker, a bottom-end plug and a top-end cap.

* * * * *